US005866070A

United States Patent [19]

Watanabe et al.

[11] Patent Number: 5,866,070

[45] Date of Patent: Feb. 2, 1999

[54] METHOD FOR PRESERVING ADHESIVE TAPE AND METHOD FOR PRESERVING ARTICLE USING THE SAME

[75] Inventors: Hideaki Watanabe; Takayuki Watanabe; Teruo Takeuchi; Junko Baba, all of Tokyo, Japan

[73] Assignee: Mitsubishi Gas Chemical Company, Inc., Tokyo, Japan

[21] Appl. No.: 595,922

[22] Filed: Feb. 6, 1996

[30] Foreign Application Priority Data

Feb. 8, 1995 [JP] Japan ..... 7-20496

[51] Int. Cl.[6] ..... B65D 81/26

[52] U.S. Cl. ..... 422/40; 206/204; 206/205; 206/813

[58] Field of Search ..... 422/40, 9; 206/204, 206/205, 813

[56] References Cited

U.S. PATENT DOCUMENTS 3,638,651 2/1972 Torr .

4,966,301 10/1990 Yamashita et al. .

5,286,407 2/1994 Inoue et al. .

5,305,948 4/1994 Yoshikawa et al. .

5,378,428 1/1995 Inoue et al. .

5,415,907 5/1995 Inoue et al. .

5,605,720 2/1997 Allen et al. ..... 427/288

5,682,453 10/1997 Daniel et al. .

*Primary Examiner*—E. Leigh McKane

*Attorney, Agent, or Firm*—Armstrong, Westerman, Hattori, McLeland & Naughton

[57] ABSTRACT

Disclosed is a method for preserving an adhesive tape or an article using the same which comprises enclosing an adhesive tape or an article using the same in a container having a gas barrier property, substantially capable of removing both oxygen and moisture, and then, sealing the container to remove substantially both oxygen and moisture from the container.

16 Claims, No Drawings

METHOD FOR PRESERVING ADHESIVE TAPE AND METHOD FOR PRESERVING ARTICLE USING THE SAME

BACKGROUND OF THE INVENTION

1. Field of the Invention

The present invention relates to a method for preserving an adhesive tape and a method for preserving an article to which the same has been applied (hereinafter, referred to as "article using the same"), and more particularly to a method for preserving which comprises enclosing an adhesive tape (or an article using the same) together with an oxygen absorbent and a drying agent in a container having a gas barrier property and then sealing the container.

2. Prior Art

In adhesive tapes, adhesives including rubber adhesives, acrylic adhesives, vinylic adhesives, silicone adhesives etc., are used depending upon the characteristics of the adhesive. The adhesives applied to the tapes are degraded due to environmental causes such as oxygen, heat, light, ozone, moisture, etc. Thus, an unused roll-wound adhesive tape during storage or an adhesive tape attached to articles during use is degraded often causing various troubles.

In order to inhibit degradation of an adhesive tape, adhesives with degradation-inhibitor added are used. The degradation of an adhesive is mostly due to oxidation. It is known that as degradation-inhibitors, usually aldehydes, amines, phenols, etc., are suitable in the same manner as in rubber products. However, since most of them have contaminative property, uncontaminative substances need to be selected in a transparent or white tape. Furthermore, even when a degradation-inhibitor has been added, it is not always perfect. Also in an adhesive tape wherein a degradation-inhibitor has been added, when the adhesive tape or an article using the same was preserved for a long time or exposed to severe environments of high temperature and high humidity even for a short time, in some cases a release paper became difficult to peel off, and stringiness occurred and furthermore durability disappeared due to deterioration of adhesive force.

Although recently, processes using chip-form electronic parts attached to a carrier tape, to continuously mount the chip-form electronic parts on the surface of printed circuit boards while peeling them from the carrier tape by means of an automatic mounting machine have become common in the electronics industry, ageing of the carrier tape to which the chip-form electronic parts are attached has become problem. It is troublesome if the carrier tape on which chip-form electronic parts are loaded is degraded and its adhesion is reduced during transportation or storage, resulting in the release of the electronic parts from the carrier tape. It is also undesirable for peel strength to increase. Still more, when stringiness occurs, continuous mounting of electronic parts may be disturbed and products may be contaminated.

In order to inhibit degradation of an adhesive tape, drying agents including silica gel, etc., have been used for preservation of adhesive tape and an article using the same. When moisture was merely removed to provide dry atmosphere, the effects of preservation were insufficient because deterioration of function always occurred due to deterioration of adhesion. Thus, although application of a drying agent together with an oxygen absorbent has been attempted using, for example, already known oxygen absorbents containing metals and metal salts including, typically, iron powders and iron salts and organic compounds including, typically, catechol and ascorbic acid as the main ingredients, good preservation has not yet been secured. Thus, under the present situation, no simple and easy method for preserving an adhesive tape or an article using the same has yet been found.

SUMMARY OF THE INVENTION

An object of the present invention, in order to solve above-mentioned problems, is to provide a method for preserving an adhesive tape or an article using the same wherein simple and easy preservation is secured and furthermore no deterioration of function due to degradation of the adhesive tape occurs during preservation.

As a result of an extensive study for solving the above-mentioned prior problems, the present inventors have found that it is necessary to remove both moisture and oxygen during preservation of an adhesive tape in order to solve the above-mentioned prior problems and the above-mentioned object can be attained by enclosing an adhesive tape or an article using the same together with an oxygen absorbent requiring no moisture and a drying agent in a container having a gas barrier property and then sealing the container, and established the present invention.

The present invention provides a method for preserving an adhesive tape which comprises:

enclosing an adhesive tape in a container having a gas barrier property, substantially capable of removing both oxygen and moisture, and then, sealing the container to remove substantially both oxygen and moisture from the container.

The present invention provides also a method for preserving an article using an adhesive tape which comprises:

enclosing an article using an adhesive tape in a container having a gas barrier property, substantially capable of removing both oxygen and moisture, and then, sealing the container to remove substantially both oxygen and moisture from the container.

Furthermore, the above-mentioned methods according to the present invention have the following preferable embodiments.

That is, in the methods for preserving, an adhesive tape or an article using the same is enclosed together with an oxygen absorbent requiring no moisture for absorption of oxygen and a drying agent.

In the methods for preserving, an adhesive tape or an article using the same is enclosed together with an oxygen absorbent requiring no moisture for absorption of oxygen, a drying agent and an acidic gas absorbent.

In the methods for preserving according to the present invention for preserving, the oxygen absorbent contains at least one compound selected from the group consisting of unsaturated fatty acid compounds and linear hydrocarbon polymers having an unsaturated group(s) as main ingredient and a substance to promote oxygen absorption.

In the methods for preserving according to the present invention, the oxygen absorbent, the drying agent, or a mixture of the oxygen absorbent and the drying agent is covered with a gas-permeable packing material to form a parcel, and more preferably the parcel is further covered with a material releasing no dust to form a double-packed parcel.

Further, in the method for preserving an article using an adhesive tape, the article using an adhesive tape is a carrier tape reel loaded with electronic parts, more preferably a carrier tape reel loaded with chip-form electronic parts.

DETAILED DESCRIPTION OF THE INVENTION

The present invention will be described in detail below.

The method according to the present invention (hereinafter, referred to as "the present method") is applied to various species of adhesive tapes or articles using the same wherein adhesives including rubber adhesive, acrylic adhesive, vinylic adhesive, silicone adhesive, etc., are used.

The adhesive tape being used in the present invention includes various species depending upon a combination between species of a support and a polymer of an adhesive, shapes, etc., according to uses and properties thereof. Examples of the adhesive tape include office use adhesive tapes for packaging including, typically, cellophane adhesive tapes, adhesive double coated tapes, adhesive labels, adhesive tapes for surface-mounting of electronic parts including, typically, adhesive carrier tapes, adhesive tapes for medical use including, typically, sticking plasters, adhesive tapes for electrical insulation including, typically, vinyl chloride adhesive tapes, adhesive tapes for coating including, typically, masking tapes, particular adhesive tapes including, typically, metallic foils, adhesive sheets including, typically, wall papers and insecticidal adhesive sheets, etc.

The present method is applied also to an article using the above-mentioned adhesive tape, and particularly suitable to preservation of a carrier tape reel loaded chip-form electronic parts including IC, resistor, diode capacitor, etc.

In the present method, it is necessary to enclose the above-mentioned adhesive tape or an article using the same in a container having a gas barrier property, substantially capable of removing both oxygen and moisture and then seal the container to remove substantially both oxygen and moisture in the container. The term "remove the oxygen substantially from the container" used herein means to maintain an oxygen concentration in the container to 5% or below, preferably 1% or below, more preferably 0.1% or below. Further, the term "remove moisture substantially from the container" used herein means to maintain a relative humidity in the container of 10% or below, preferably 5 % or below, and more preferably 1% or below.

When oxygen concentration and relative humidity exceed the above-mentioned range, respectively, degradation of adhesive proceeds during preservation, whereby in using an adhesive tape, e.g., an adhesive tape wound in a roll form, it becomes difficult to peel off the adhesive tape since peeling strength in increases due to hardening of the adhesive; stringiness occurs; adhesive force and sticking force in sticking actually deteriorate, and durability disappears.

It is required that the oxygen absorbent being used in the present invention is capable of absorbing oxygen under dry conditions. Oxygen absorbent requiring no moisture for absorption of oxygen is preferably used. Particularly, oxygen absorbents containing at least one compound selected from the group consisting of unsaturated fatty acid compounds and linear hydrocarbon polymers having an unsaturated group(s) as main ingredient and a substance to promote oxygen absorption is more preferably used.

Regarding the oxygen absorbent, in oxygen absorbents requiring moisture for oxygen absorption, it is necessary to hold moisture in the oxygen absorbent itself when it is used under dry conditions. Even if a moisture holding type oxygen absorbent is used in the present invention, the object of the present invention cannot be attained and it cannot be applied to the present method because oxygen absorption is stopped in the course of absorption or drying ability of a drying agent is reduced.

The oxygen absorbent of the present invention comprises at least one compound selected from the group consisting of unsaturated fatty acids compound and linear hydrocarbon polymers having an unsaturated group(s) as the main ingredient, a substance to promote oxygen absorption and a carrier substance and preferably further contains an acidic gas absorbent. When an acidic gas exists during preservation of an adhesive tape, degradation of the adhesive is promoted. Therefore, it is preferable to additionally remove acid gases by using further an acidic gas absorbent.

The unsaturated fatty acid compound being used herein is an unsaturated fatty acid having at least 10 carbon atoms and at least one carbon-carbon double bond, and/or a salt or ester thereof. The unsaturated fatty acids, salts and esters thereof may optionally contain a substituted group(s), e.g., hydroxyl group, formyl group, etc. The unsaturated fatty acid compound is not necessarily a pure substance.

Examples of the unsaturated fatty acid compound include unsaturated fatty acids such as oleic acid, linoleic acid, linolenic acid, arachidonic acid, parinaric acid, dimer acid, ricinoleic acid, etc., esters thereof, fats and oils containing esters thereof and metal salts thereof.

As the unsaturated fatty acid, fatty acids obtained from vegetable oils and animal oils, i.e., linseed oil fatty acid, soybean oil fatty acid, tung oil fatty acid, rice bran oil fatty acid, sesame oil fatty acid, cotton seed oil fatty acid, rapeseed oil fatty acid, tall oil fatty acid, and the like are usable in the present invention.

The linear hydrocarbon polymer having an unsaturated group(s) means a polymer having at least 10 carbon atoms and at least one carbon-carbon double bond and derivatives thereof. The derivatives may optionally contain substituted groups including hydroxyl group(s), amino group(s), formyl group(s), carboxyl group(s), etc.

Examples of the linear hydrocarbon compound having an unsaturated group(s) includes an oligomer or polymer of butadiene, isoprene, 1,3-pentadiene etc. The linear hydrocarbon compound having an unsaturated group(s) is not necessarily a pure substance, and may be contain a small amount of impurities within the ordinary range such as residue of a solvent mixed in during production.

Examples of the substance to promote oxygen absorption include metal salts and radical initiators. As the metal salts, transition metal salts such as those of Cu, Fe, Co, Ni, Cr, Mn, etc., are preferably used. As the transition metal salts, for example, transition metal salts of unsaturated fatty acids are preferably used.

Examples of the carrier substance include paper or synthetic paper formed of natural pulp or synthetic pulp, silica gel, alumina, activated carbon, zeolite, pearlite, activated clay, etc. Particularly, when the main ingredient is a liquid substance, it is preferred that an adsorptive substance is used as the carrier substance. Further, it is a practical method for use also to select a carrier substance that has also been selected as the drying agent and maintain the carrier drying ability.

The acidic gas absorbent may be a substance capable of absorbing or adsorbing acidic substances being produced by reaction of the main component or acidic substances introduced in to preserving atmosphere. For example, oxides, hydroxides, carbonates and organic acid salts of alkali metals or alkaline earth metals and organic amines are usable. Further, it is possible also to select an acidic gas absorbent as the above-mentioned carrier substance or drying agent and have the acidic gas absorbent maintain the above-mentioned carrier function and/or drying ability. In such case, further acidic gas absorbent need not be added.

Each component in the oxygen absorbent is used in the following proportions. That is, per 100 parts by weight of a main ingredient, the amount of the substance used to promote oxygen absorption is in the range of 0.001 to 40 parts by weight; that of the carrier substance is in the range of 1 to 1,000 parts by weight and that of the acid gas absorbent is in the range of 1 to 1,000 parts by weight, if necessary. When the substance to promote oxygen absorption is a transition metal salt, it is used in the above-mentioned range converted into weight of the transition metal.

Although the oxygen absorbent is used in a mixture with the above-mentioned components, considering the efficiency, it is preferable to support a liquid substance on the carrier substance in advance. Further, the oxygen absorbent is suitably used in the form of granules, tablets, sheets, etc. The oxygen absorbent is usually used as a parcel covered with a known gas permeable packing material used a substrate, e.g., paper or non-woven fabric. The form of the parcel is not limited, and may optionally have a form, e.g., bag, sheet, blister container depending upon the object to be preserved. As a dust proofing treatment, the parcel can be further covered with a material that does not hinder the permeation of either oxygen and moisture and releases no dust generated from the parcel into exterior, thus forming a double-packed parcel. However, when the dust proofing treatment has been conducted for the parcel itself, the parcel need not to be further covered with a dust proof material.

Examples of the drying agent used in the present invention include paper or synthetic paper formed of natural pulp or synthetic pulp, silica gel, alumina, activated carbon, zeolite, pearlite, activated clay, calcium oxide, barium oxide, calcium chloride, barium bromide, calcium hydride, calcium sulfate, magnesium chloride, magnesium oxide, magnesium sulfate, aluminum sulfate, sodium sulfate, sodium carbonate, potassium carbonate, zinc chloride, etc.

The drying agent may be used without being packed, or in a form of parcel and also in a mixture with the above-mentioned oxygen absorbent.

The oxygen absorbent is used in an amount capable of absorbing at least the space volume of oxygen in the interior of a sealed container, preferably in an amount of 1.1 to 10 times to the above-mentioned space volume. Further, the drying agent is used in an amount capable of absorbing at least the space volume of moisture in the interior of a sealed container, preferably in an amount of 1.1 to 500 times to the above-mentioned space volume. The oxygen absorbent and the drying agent are suitably used in each respective amount with in the above-mentioned ranges depending upon gas barrier performances of the container having a gas barrier property.

As the container having a gas barrier property of the present invention, a container formed of a material having a gas barrier property including plastic containers, film bags, metal containers, glass containers, etc., is selected depending upon the object to be preserved.

It is preferred that the container having a gas barrier property has an oxygen permeability of 10 ml/m$^2$.Day.atm or below at 25° C. at a relative humidity (hereinafter, referred to as "RH") of 60% and a water vapor permeability of 1 g/m$^2$.Day or below at 40° C. at 90% RH. It is advantageous in cost to select the gas barrier performance depending upon the object to be preserved so as not to provide excess performance.

Further, when an adhesive tape or an article using an adhesive tape is enclosed in a container and then the container is sealed, the interior of the container may be charged optionally with a dry inert gas, e.g., dry nitrogen gas. The gas replacement brings about reduction of each amount of oxygen absorbent and drying agent being used, and particularly the amount of oxygen absorbent being used.

PREFERRED EMBODIMENTS OF THE INVENTION

The present invention will be described in detail below, referring to Examples, which are not intended to limit of the present invention.

EXAMPLE 1

(Preparation of gas absorbent parcel)

350 parts by weight of zeolite and a mixture of 100 parts by weight of soybean oil with 20 parts by weight of cobalt naphthenate was mixed with a blender. The resultant mixture was allowed to stand at 25° C. for 10 minutes to obtain a granular composition. A mixture of 5 g of the thus obtained granular composition with 2.5 g of calcium oxide was filled into a small bag formed of paper (size; 5 cm×7.5 cm), laminated with porous polyethylene film on its interior side. The bag was further covered with a gas permeable packing material releasing no dust, GOATEX™ (porous PTFE film), made by Japan Goatex K.K., Japan to prepare a gas absorbent parcel (hereinafter, referred to as "gas absorbent").

(Preservation test of cellotape)

One roll of cellotape, i.e., office use cellophane adhesive tape (hereinafter, referred to as "cellotape"), made by Nichiban K.K., Japan, roll-wound in 18 mm width and 50 m length and one parcel of the gas absorbent prepared above were enclosed in a packing bag formed of an aluminum foil laminate (stretched polypropylene /aluminum foil/ polyethylene); size 220 mm ×300 mm (hereinafter, referred to as "Al bag") and then the opened portion of the Al bag was heat sealed in the state enclosed together 500 ml of air at 25° C. and 75% RH to seal hermetically. The hermetically sealed Al bag was preserved for four weeks under an atmosphere of 40° C. and 95% RH.

After preserving for four weeks, both the oxygen concentration and the moisture concentration in the sealed Al bag were determined by gaschromatography. It was found that neither oxygen nor moisture were substantially present in the interior of the sealed Al bag. Then, the sealed Al bag was opened and the roll-wound cellotape was taken out. The following peeling test was conducted for the roll-wound cellotape to measure peel strength and observe the state of peeling.

(Peeling test for cellotape)

The roll-wound cellotape of 18 mm width was set to an office use tape cutter so that it could rotate and then the end was nipped with grips for tensile test having 20 mm width and the peel strength when drawn in a tangential direction was measured with a portable load measuring instrument, made by Aiko Engineering K.K., Japan, AE-3 type . Further, the state of the roll-wound cellotape was observed visually. The result is shown in Table 1.

In the roll-wound cellotape preserved for four weeks, no stringiness phenomenon was observed in the peeling test and the peel strength was 0.6 kg/18 mm width. Thus, the measured value of the peel strength was the same as that before the starting of preservation test and the cellotape was smoothly peeled off from the roll.

Comparative Examples 1 to 3

As comparative Examples for Example 1, the preservation tests for a roll-wound cellotape were conducted without using the gas absorbent of the present invention as follows.

Only one roll of roll-wound cellotape in Comparative Example 1, both one roll of roll-wound cellotape and one parcel containing 2 g of Fuji.SILICAGEL™, A-type silica gel, made by Fuji Devison Kagaku, K.K., Japan in Comparative Example 2 and both one roll of roll wound cellotape and one parcel of self-reacting type iron powder oxygen absorbent holding moisture necessary for oxygen absorption reaction, AGELESS™ Z-100PT, made by Mitsubishi Gas Chemical Inc., Japan in Comparative Example 3, respectively were enclosed together with 500 ml of air at 25° C. and 75% RH in an Al bag and then all of the Al bags were hermetically sealed. The Al bags enclosing the roll-wound cellotape were preserved under atmosphere of 40° C. and 95% RH for four weeks.

After four weeks, both the oxygen concentration and the moisture concentration in the sealed Al bags were determined in the same manner as in Example 1 and then the roll-wound cellotape was taken out from the sealed Al bags. The peeling test was conducted for the roll-wound cellotape. The results of Comparative Examples 1 to 3 are shown in Table 1.

In all for the roll-wound cellotape preserved for four weeks in Comparative Examples 1 to 3, the stringiness phenomenon was observed in the peeling test. The peel strength also increased more than that before the starting of preservation test and it became somewhat difficult to peel the cellotape off from the roll.

EXAMPLES 2 to 4

In Examples 2 to 4, the gas absorbents were prepared in the same manner as in Example 1 except that the combination between main ingredient and a substance to promote oxygen absorption in the gas absorbent of Example 1 was changed respectively as follows:

| Example | main ingredient 100 parts by weight | substance to promote oxygen absorption 20 parts by weight |
|---|---|---|
| 1 | soybean oil | cobalt naphthenate |
| 2 | tall oil fatty acid | cobalt naphthenate |
| 3 | soybean oil | cobalt salt of tall oil fatty acid |
| 4 | soybean oil + liquid polyisoprene (*) | cobalt naphthenate |

(*) Note:
a mixture of soybean oil: liquid polyisoprene (DAICLEAN ™ R 11, made by Japan Synthetic Rubber Co., Japan) = 6:4 (ratio by weight).

The preservation test for the roll-wound cellotape was conducted in the same manner as in Example 1, using the thus obtained gas absorbents. The results of the preservation test are shown in Table 2.

EXAMPLE 5

Both one roll of a carrier tape loaded actually chip form resistors, made by Kamaya Electric Co., LTD., 511J-type, on an adhesive carrier tape, made by Okuitoku, K.K., being used by sticking flat electronic parts for surface mounting on the surface of an adhesive tape and one parcel of the gas absorbent prepared in Example 1 were enclosed in a Al bag formed of an aluminum foil laminate (size; 220 mm×300 mm) and the opening portion of the Al bag was hermetically heat sealed so that 500 ml of air at 25° C. and 75% RH were contained inside. The hermetically sealed Al bag enclosing the carrier tape loaded with chip form-resistors was preserved for four weeks under an atmosphere of 40° C. and 95% RH.

After four weeks, both the oxygen concentration and the moisture concentration in the sealed Al bag were determined. Then, the sealed Al bag was opened and the carrier tape loaded with chip-form resistors was taken out. The chip form-resistors attached to the carrier tape were peeled off one by one to observe the state of peeling. As a result, when the chip form-resistors were peeled off from the adhesive tape, no stringiness was observed in the adhesive and the resistors were smoothly peeled off and furthermore the state of peeling was the same as that before starting the preservation test. Oxygen and moisture were not substantial present in the interior of the sealed Al bag.

The carrier tape loaded with chip form-resistors preserved for four weeks in Example 5 was introduced into a chip-form electronic part automatic mounting machine to mount continuously the chip-form resistors on a printed substrate. No problems occurred. The results are shown in Table 3.

Comparative Examples 4 to 7

As Comparative Examples for Example 5, the preservation tests for a carrier tape loaded with chip-form resistors were conducted without using the gas absorbent of the present invention as follows.

That is, only one roll of carrier tape loaded with chip-form resistors in Comparative Example 4, both one roll of carrier tape loaded with chip-form resistors and one parcel containing 2 g of Fuji-SILICAGEL™, A-type (silica gel), made by Fuji- Devison Kagaku K.K., Japan, in Comparative Example 5 and both one roll of carrier tape loaded with chip-form resistors and moisture holding type iron powder oxygen absorbent, AGELESS™ Z-100PT, made by Mitsubishi Gas Chemical Inc., Japan in Comparative Example 6, respectively were enclosed together with 500 ml of air at 25° C. at 75% RH in an Al bag and these Al bags were all hermetically sealed. Further, in Comparative Example 7, only one roll of carrier tape loaded with chip-form resistors was enclosed together with 500 ml of dry nitrogen and then the Al bag was hermetically sealed. The Al bags enclosing a carrier tape loaded with chip-form resistors were preserved under an atmosphere of 40° C. and 95% RH for four weeks.

After four weeks, both the oxygen concentration and the moisture in the sealed Al bag were determined in the same manner as in Example 5 and then the carrier tape loaded with chip-form resistors was taken out from the sealed Al bag. The chip-form resistors attached to the carrier tape were peeled off one by one to observe the state of peeling.

In Comparative Example 4, when chip form-resistors were peeled off from the surface of the adhesive tape, the stringiness phenomenon in the adhesive was observed overall. Further, in Comparative Examples 5 to 7, although the degree of stringiness was smaller than that in Comparative Example 4, the stringiness phenomenon was observed. When stringiness occurred in a carrier tape-loaded with chip-form resistors, in introduction of the carrier tape into an automatic mounting machine, pick-up misses occurred and furthermore the printed substrate or pick-up mechanism was contaminated due to adhesion of a detached adhesive brought about stringiness. Therefore, it was observed that the methods in Comparative Examples 4 to 7 were impractical. The test results of Comparative Examples 4 to 7 are shown in Table 3.

According to the present method, when an adhesive tape or an article using the same is enclosed together with an oxygen absorbent and a drying agent, preferably further together with an acidic gas absorbent, in a container having a gas barrier property and then the container is sealed, the adhesive tape or an article using the same can be favorably preserved according to a very simple and easy method. Furthermore, according to the present method, an adhesive tape or an article using the same is maintained in atmosphere where both oxygen and moisture have been substantially removed, whereby degradation of the adhesive tape is inhibited and no problems of unsuitable peel strength due to hardening of the adhesive during use or stringiness occur and furthermore the adhesive force or the sticking force does not deteriorate during use. Particularly, when a carrier tape reel loaded with chip-form electronic parts including IC, resistor, diode, capacitor, etc., are preserved according to the present method, no stringiness occurs in the adhesive during peeling off of the chip-form electronic parts from the carrier tape, whereby contamination due to an adhesive brought about by stringiness can be prevented.

TABLE 1

| Item | Example 1 | Comp. Ex. 1 | Comp. Ex. 2 | Comp. Ex. 3 |
|---|---|---|---|---|
| Treatment in interior of preserving bag | Gas absorbent of the present invention enclosed | Non-treated | Drying agent enclosed | Moisture-holding type iron powdery oxygen absorbent enclosed |
| Interior of bag after 4 weeks Oxygen concentration (%) | 0.04 | 21 | 21 | 0.05 |
| Humidity (% RH) | <1 | 75 | 5 | 80 |
| State of stringiness of adhesive | Stringiness did not occur The same state as in initial stage | Stringiness occurred | Stringiness occurred | Stringiness occurred |
| Peel strength (kg/18 mm width) | 0.6 The same state as in initial stage | 1.1 | 0.9 | 0.9 |

TABLE 2

| Item | Example 1 | Example 2 | Example 3 | Example 4 |
|---|---|---|---|---|
| Organic compound as main ingredient | Soybean oil | Tall oil fatty acid | Soybean oil | Soybean oil + Liquid polyisoprene |
| Substance to promote oxygen absorption | Cobalt naphthenate | Cobalt naphthe nate | Cobalt salt of tall oil fatty acid | Cobalt naphthenate |
| Interior of bag after 4 weeks Oxygen concentration (%) | 0.04 | 0.03 | 0.04 | 0.03 |
| Humidity (% RH) | <1 | <1 | <1 | <1 |
| State of stringiness of adhesive | Stringiness did not occur The same state as in initial stage | Stringiness did not occur The same state as in initial stage | Stringiness did not occur The same state as in initial stage | Stringiness did not occur The same state as in initial stage |
| Peel strength (kg/18 mm width) | 0.6 The same state as in initial stage | 0.6 The same state as in initial stage | 0.6 The same state as in initial stage | 0.6 The same state as in initial stage |

TABLE 3

| Item | Example 5 | Comp.Ex.4 | Comp.Ex.5 | Comp.Ex.6 | Comp.Ex.7 |
|---|---|---|---|---|---|
| Treatment in interior of preserving bag | Gas absorbent of the present invention enclosed | Non-treated | Drying agent enclosed | Moisture-holding type iron powdery oxygen absorbent enclosed | Replacement with dry nitrogen gas |
| Interior of bag after 4 weeks Oxygen concentration (%) | 0.04 | 21 | 21 | 0.06 | 0.05 |
| Humidity (% RH) | <1 | 75 | 6 | 80 | 33 |
| State of stringiness of adhesive | Stringiness did not occur The same state as in initial stage | Substantial stringiness occurred | Stringiness occurred | Stringiness occurred | Stringiness occurred |
| Applicability to automatic mounting with chip part mounting machine | No problem | Inapplicable | Inapplicable | Inapplicable | Inapplicable |

What is claimed is:

1. A method for preserving an adhesive tape which comprises:

enclosing an adhesive tape containing an adhesive selected from the group consisting of rubber adhesive, acrylic adhesive, vinylic adhesive and silicone adhesive, in a container having a gas barrier property with an oxygen permeability of 10 ml/$m^2$.Day.atm or below at 25° C. at 60% RH and a water vapor permeability of 1 g/$m^2$.Day or below at 40° C. at 90% RH, together with an oxygen absorbent requiring no moisture for absorption of oxygen and a drying agent which are substantially capable of removing both oxygen and moisture, and then, sealing the container to remove substantially both oxygen and moisture from the container.

2. The method for preserving according to claim 1, wherein the adhesive tape is enclosed together with an acidic gas absorbent.

3. The method for preserving according to claim 1, wherein the oxygen absorbent contains at least one compound selected from the ground consisting of unsaturated fatty acid compounds and linear hydrocarbon polymers having at least one unsaturated group as a main ingredient and a substance to promote oxygen absorption.

4. The method for preserving according to claim 3, wherein the oxygen absorbent further contains a carrier substance.

5. The method for preserving according to claim 1, wherein the interior of the container is maintained at an oxygen concentration of 5% or below and a relative humidity of 10% or below.

6. The method for preserving according to claim 1, wherein the oxygen absorbent, the drying agent, or a mixture of the oxygen absorbent and the drying agent is covered with a gas-permeable packing material to form a parcel.

7. The method for preserving according to claim 6, wherein the parcel is further covered with a material releasing no dust to form a double-packed parcel.

8. A method for preserving an article using an adhesive tape which comprises:

enclosing an article using an adhesive tape containing an adhesive selected from the group consisting of rubber adhesive, acrylic adhesive, vinylic adhesive and silicone adhesive, in a container having a gas barrier property with an oxygen permeability of 10 ml/$m^2$.Day.atm or below at 25° C. at 60% RH and a water vapor permeability of 1 g/$m^2$.Day or below at 40° C. at 90% RH, together with an oxygen absorbent requiring no moisture for absorption of oxygen and a drying agent which are substantially capable of removing both oxygen and moisture, and then, sealing the container to remove substantially both oxygen and moisture from the container.

9. The method for preserving according to claim 8, wherein the article using an adhesive tape is enclosed together with an acidic gas absorbent.

10. The method for preserving according to claim 9, wherein the oxygen absorbent contains at least one compound selected from the group consisting of unsaturated fatty acid compounds and a linear hydrocarbon polymers having at least one unsaturated group as a main ingredient and a substance to promote oxygen absorption.

11. The method for preserving according to claim 10, wherein the oxygen absorbent further contains a carrier substance.

12. The method for preserving according to claim 8, wherein the interior of the container is maintained at an oxygen concentration of 5% or below and a relative humidity of 10% or below.

13. The method for preserving according to claim 8, wherein the oxygen absorbent, the drying agent, or a mixture of the oxygen absorbent and the drying agent is covered with a gas-permeable packing material to form a parcel.

14. The method for preserving according to claim 13, wherein the parcel is further covered with a material releasing no dust to form a double-packed parcel.

15. The method for preserving according to claim 8, wherein the article using an adhesive tape is a carrier tape reel loaded with electronic parts.

16. The method for preserving according to claim 15, wherein the electronic parts have a chip form.

* * * * *